US006626749B2

(12) United States Patent
Neborsky et al.

(10) Patent No.: US 6,626,749 B2
(45) Date of Patent: Sep. 30, 2003

(54) COIN HOPPER STATUS DETECTION AND REPORTING SYSTEM

(75) Inventors: Francis L. Neborsky, East Lyme, CT (US); James P. Brennan, Colchester, CT (US)

(73) Assignee: Mohegan Tribal Gaming Authority, Uncasville, CT (US)

( * ) Notice: Subject to any disclaimer, the term of this patent is extended or adjusted under 35 U.S.C. 154(b) by 54 days.

(21) Appl. No.: 09/865,094

(22) Filed: May 24, 2001

(65) Prior Publication Data

US 2001/0055945 A1 Dec. 27, 2001

Related U.S. Application Data

(60) Provisional application No. 60/207,745, filed on May 30, 2000.

(51) Int. Cl.[7] ..... G07D 9/00
(52) U.S. Cl. ..... 453/17
(58) Field of Search ..... 453/17

(56) References Cited

U.S. PATENT DOCUMENTS 4,398,550 A 8/1983 Shireman
5,356,332 A 10/1994 Thompson et al.
5,467,857 A * 11/1995 Takemoto ..... 194/206
5,755,618 A * 5/1998 Mothwurf ..... 453/17
5,810,654 A 9/1998 Suzuki et al.
5,819,901 A 10/1998 Filiberti
5,913,399 A * 6/1999 Takemoto et al. ..... 194/200
5,954,576 A 9/1999 Coulter et al.
6,066,038 A * 5/2000 Sciortino et al. ..... 222/56

FOREIGN PATENT DOCUMENTS

GB 2257553 A * 1/1993 ..... G07D/1/00
JP 04257992 A * 9/1992 ..... G07F/17/34

* cited by examiner

*Primary Examiner*—Kathy Matecki
*Assistant Examiner*—Sang Kim
(74) *Attorney, Agent, or Firm*—Cantor Colburn LLP

(57) ABSTRACT

An apparatus for detecting when a coin hopper in a gaming machine is low on coins and alerting the operator that service is required. An exemplary embodiment employs a system, which includes a probe for detecting the coin level and providing a signal to a detection circuit, and a circuit that receives the probe signal for determination of the low coin hopper condition. The circuit also provides a signal for illuminating an enunciator to inform the operator of the status of the gaming machine; and a signal to inform a central computer system of the status of the gaming machine.

5 Claims, 3 Drawing Sheets

COIN HOPPER STATUS DETECTION AND REPORTING SYSTEM

CROSS-REFERENCE TO RELATED APPLICATIONS

This application claims the benefit of U.S. provisional application No. 60/207,745, filed May 30, 2000 the contents of which are incorporated by reference herein in their entirety.

BACKGROUND

In the gaming business, casinos are subject to continuous operation, (commonly operating 24 hours a day and seven days a week). Current gaming machine art and operations dictate that casinos constantly monitor the amount of coins in a hopper of a gaming or slot machine. When the hopper reaches a low or empty condition, an attendant must service the machine and replenish the coins in the hopper. Such servicing usually interferes with the patron's ability to play the slot machine. Because the revenue generated by a gaming machine is related to the amount of time patrons are playing, any interruption in operation impacts revenues. Further, taking a machine out of service while a patron is utilizing it may discourage the patron and cause them to stop using the machine all together. Thus, there is a need for a casino to be appraised of which gaming machines require refilling and to refill hoppers in the least intrusive manner possible, thereby increasing the utility and availability of the gaming machine to its patrons.

BRIEF SUMMARY

Disclosed is an apparatus for detecting when a coin hopper in a gaming machine is low on coins and alerting the operator that service is required. An exemplary embodiment employs a system, which includes a probe for detecting the coin level and providing a signal to a detection circuit, and a circuit that receives the probe signal for determination of the low coin hopper condition. The circuit also provides a signal for illuminating an enunciator to inform the operator of the status of the gaming machine; and a signal to inform a central computer system of the status of the gaming machine.

BRIEF DESCRIPTION OF THE DRAWINGS

Referring now to the drawings wherein like elements are numbered alike in the several FIGURES.

DETAILED DESCRIPTION OF EXEMPLARY EMBODIMENTS

The disclosed embodiments relate to the field of coin or disk handling. More specifically, in one embodiment, an improved method and apparatus for detecting low levels of coins in the coin hopper in gaming machines is disclosed.

Figure 1:
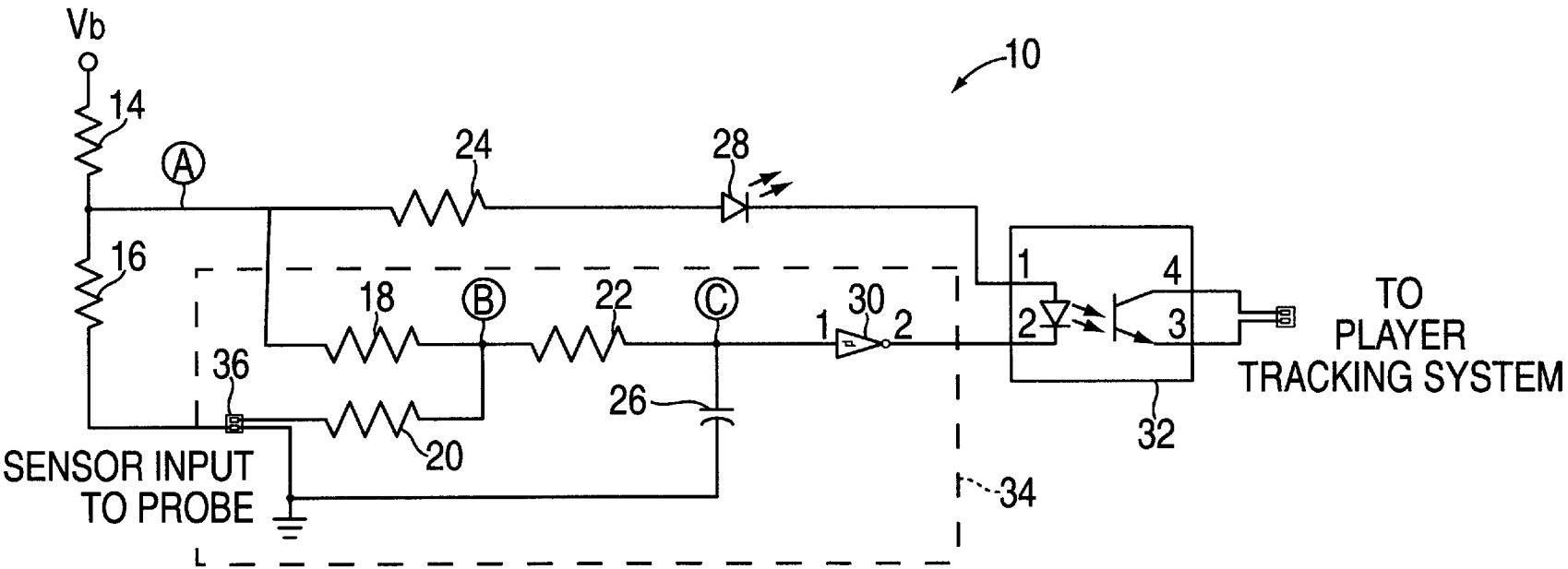
FIG. 1 is a schematic diagram of a circuit for detecting and reporting hopper status.

FIG. 1 is an electrical schematic diagram of the circuit 10 in an exemplary embodiment. The circuit 10 includes a probe interface 36 to the probe 12 (FIG. 2) for detecting the coin level in the coin hopper (not shown) and providing a signal to a detection circuit 34. The detection circuit 34 receives the signal from probe 12 for determination of the low coin hopper condition; provides a signal for illuminating an enunciator 28 (e.g., LED) to inform the operator of the status of the gaming machine; and generates a signal to inform a central computer system (not shown) of the status of the gaming machine.

The circuit 10 is divided into sections below to facilitate description.

Figure 2:
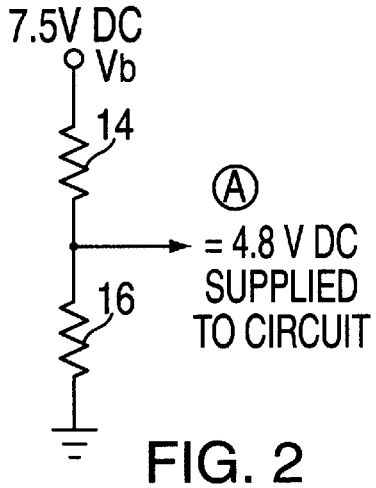
FIG. 2 is a schematic diagram showing the power supply voltage divider.

FIG. 2 depicts the voltage divider comprising a first resistor 14, which is in series with a second resistor 16. Resistor 14 is typically 100 ohms and resistor 16 is typically 180 ohms. The gaming machine supply voltage $V_b$ supplies 7.5 VDC through the voltage divider circuit yielding approximately 4.82 VDC to the detection portion of the circuit at A hereafter termed secondary supply voltage. As is well known in the art, different values of resistors may be used as long as the ratio between the two is maintained, sufficient current is supplied for the detection portion of the circuit, and the current drawn from the gaming machine supply $V_b$ is not excessive.

Figure 3:
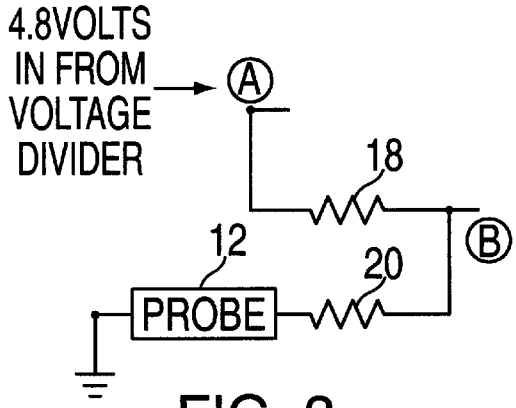
FIG. 3 is a schematic diagram showing the active portion of the detection circuit when the coin hopper level is above a limit.

FIG. 3 shows the portion of the detection circuit 34 that is active when the coin hopper level is above a predetermined limit. The predetermined limit may be set so that an operator will have an opportunity to refill the coin hopper without disrupting any patrons. The probe 12 in the coin hopper serves as a two state electrical switch and is closed when the hopper level is above the predetermined limit and open when the hopper level is below the predetermined limit. When the coin hopper level is above the predetermined limit the probe 12 is closed, providing a continuity path to ground across the probe interface 36. Thus, providing a current path for resistor 18 via resistor 20 to ground depriving the remainder of the circuit of current. Resistor 20 is approximately 360 ohms and resistor 18 is approximately 1,000 ohms. Using well-known voltage division principles, point B is kept at approximately 1.28 VDC a sufficiently low voltage to ensure that the remainder of the circuit 10 is not activated from point B. The ratio of resistor 20 to resistor 18 is kept low enough to ensure that the voltage at point B under these conditions does not charge capacitor 26 sufficiently to exceed the threshold of the control device 30. As is well known in the art, different values of resistors may be used so long as the ratio between the two is controlled to maintain the remainder of the detector circuit inactive and sufficient current is supplied for the detection circuit to operate under the active case.

Figure 4:
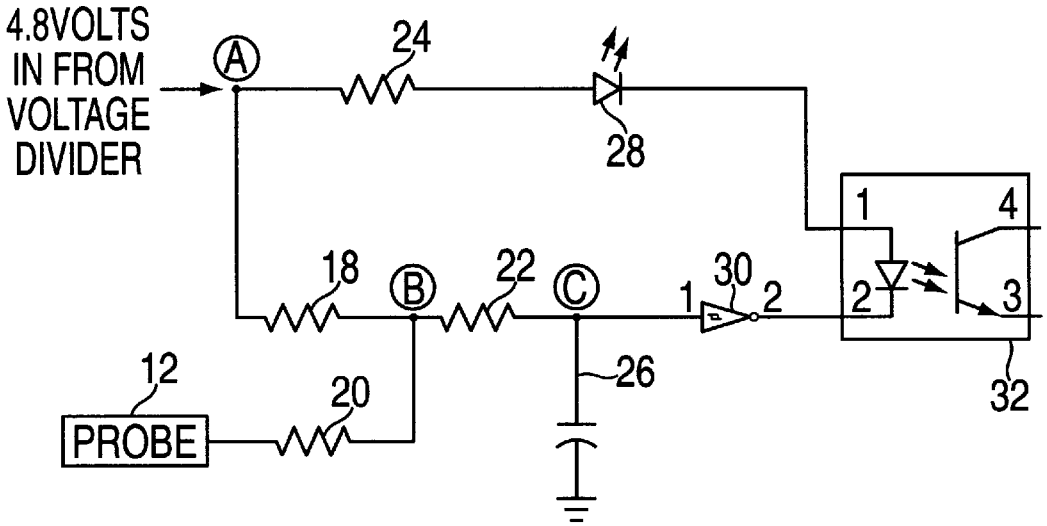
FIG. 4 is a schematic diagram showing the active portion of the detection circuit when the coin hopper is below a limit.

FIG. 4 shows a schematic diagram of the active portion of the detection circuit 34 and associated components, when the coin hopper is low on coins. When the coin hopper level is below the limit, the probe 12 provides an open circuit and thus resistor 20 is not connected to ground through the probe interface 36. When resistor 20 does not draw any current, current is instead supplied through resistor 18 to resistor 22. Capacitor 26, which is connected to point C, begins to charge as current flows through resistors 18 and 22. When the capacitor 26 charges to approximately 2.7 volts, thereby, exceeding the input threshold of the control device 30, the control device 30 transitions to its active state. Upon transitioning, the control device 30 presents a ground (or nearly ground) at its output thereby providing a current path from the secondary supply at point A through resistor 24, enunciator 28, and output device 32. The flow of current illuminates the enunciator 28 and thereby alerting the operator that the coin hopper level is low and requires service. Simultaneously, output device 32 provides a conduction path to the player tracking system (not shown) for monitoring of gaming machine service and activity. In an exemplary embodiment of the invention, the control device is a hex-Schmitt trigger inverter, while the enunciator is a light emitting diode and the output device 32 is an optocoupler. The output device 32 has an input at pins 1 and 2, and an output that provides a conduction path between pins 4 and 3.

Figure 5:
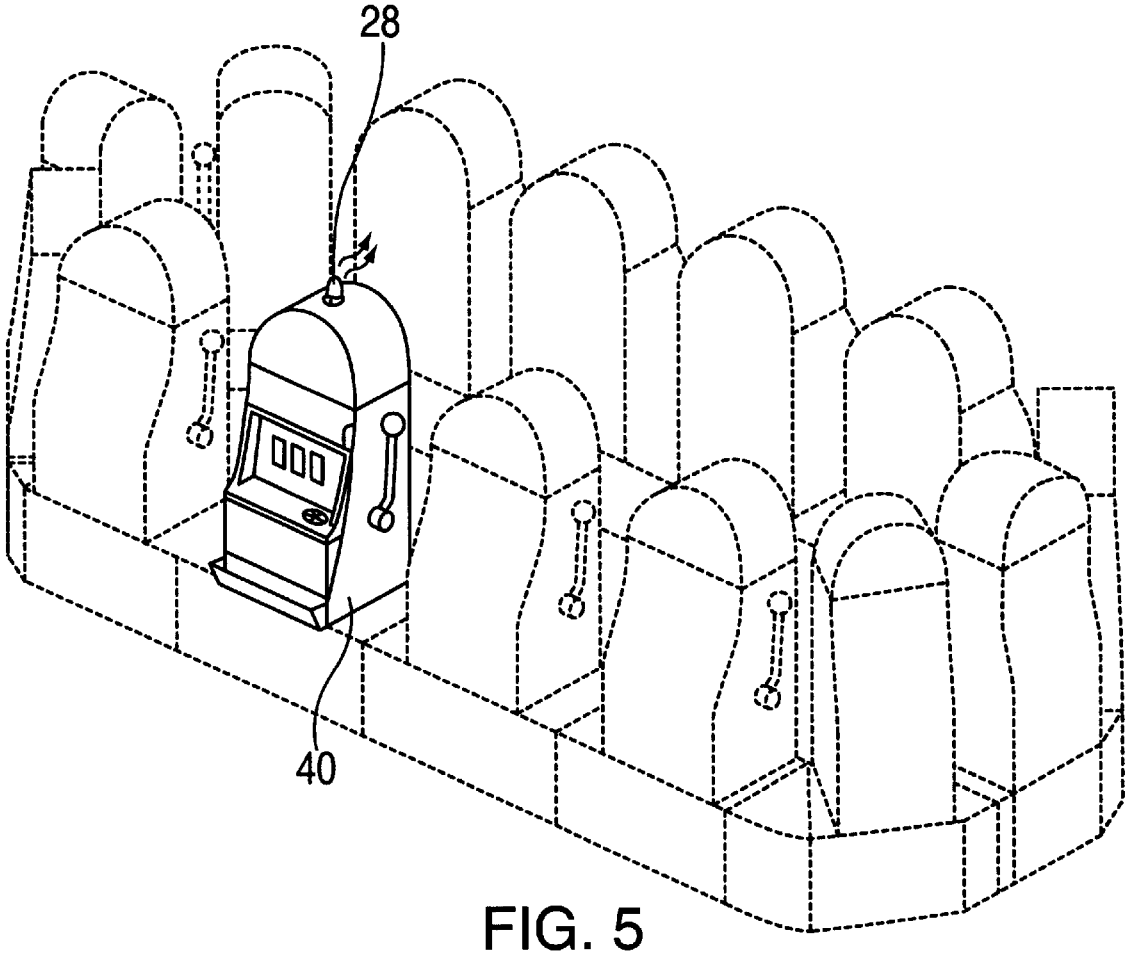
FIG. 5 is a perspective drawing showing several gaming machines having low hopper indicators active and the remote monitoring facility.

FIG. 5 depicts a gaming machine 40 in a typical carousel arrangement in a casino. The gaming machine is one of a plurality of like machines arranged in a manner to facilitate simultaneous patron access and operator service. The gaming machine 40 is shown with an illuminated enunciator 28 at or near the top.

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system for detecting the status of a gaming machine coin hopper, the system comprising:

a probe for determining the fill status of the coin hopper;

a detection circuit for determining if the coin hopper level is below a limit based upon a state of said probe;

an enunciator responsive to said detection circuit for alerting an operator as to the status of said coin hopper;

an output device responsive to said detection circuit for providing a signal to a player tracking system monitor;

a voltage divider for interfacing to the gaming machine voltage supply;

said voltage divider reducing the gaming machine supply voltage to a secondary supply voltage provided to said detection circuit;

wherein said probe comprises an electromechanical switch having two states, said switch being electrically conductive when said coin hopper level is above said limit, and non-conductive when said coin hopper level is below said limit; and wherein said probe is connected to said detection circuit via a probe interface such that said probe provides a continuity path when said coin hopper level is above said limit and an open circuit when said coin hopper level is below said limit.

2. A system for detecting the status of a gaming machine coin hopper, the system comprising:

a probe for determining the fill status of the coin hopper;

a detection circuit for determining if the coin hopper level is below a limit based upon a state of said probe;

an enunciator responsive to said detection circuit for alerting an operator as to the status of said coin hopper;

an output device responsive to said detection circuit for providing a signal to a player tracking system monitor, wherein said detection circuit receives said secondary supply voltage and said probe state;

wherein said detection circuit processes said probe state to determine the status of said coin hopper; and wherein said detection circuit includes a control device for activating said enunciator and said output device.

3. A system of claim 2 wherein:

said control device, when activated, provides a circuit path from said secondary supply voltage through a resistor, through said enunciator, and through said output device.

4. A system of claim 3 wherein:

said enunciator is an LED.

5. A system of claim 2 wherein:

said output device is an optocoupler having an input in series with said control device; and said output device provides an electrically conductive path created by an optocoupler transistor element to the player tracking system monitor.

* * * * *